US005515843A

United States Patent [19]

Chang

[11] Patent Number: 5,515,843

[45] Date of Patent: May 14, 1996

[54] THREE-LAYER HELMET ASSEMBLY WITH BREATHING GAS THROTTLE

[76] Inventor: Huang Chang, 58 Ma Yuan West St., Taichung, Taiwan

[21] Appl. No.: 185,051

[22] Filed: Jan. 24, 1994

[51] Int. Cl.[6] ..... A62B 17/04; A62B 18/10; A62B 7/10; A62B 23/02

[52] U.S. Cl. ..... 128/201.25; 128/201.24; 128/201.28; 128/204.25; 128/205.24

[58] Field of Search ..... 128/201.22–201.25, 128/205.11, 201.27, 206.12, 206.21, 206.22, 206.24, 206.26, 201.28, 204.25, 205.24

[56] References Cited

U.S. PATENT DOCUMENTS

| | | | |
|---|---|---|---|
| 2,894,508 | 7/1959 | Miles et al. | 128/206.17 |
| 3,577,988 | 5/1971 | Jones | 128/201.25 |
| 3,620,213 | 11/1971 | Savoie, Jr. | 128/201.25 |
| 3,680,555 | 8/1972 | Warncke | 128/206.24 |
| 3,976,063 | 8/1976 | Henneman et al. | 128/201.25 |
| 4,315,335 | 2/1982 | Kennedy, Jr. et al. | 128/206.24 |
| 4,502,480 | 3/1985 | Yamamoto | 128/201.25 |
| 4,590,951 | 5/1986 | O'Connor | 128/201.25 |
| 4,677,976 | 7/1987 | Fujinuma et al. | 128/206.17 |
| 5,036,842 | 8/1991 | Van der Smissen et al. | 128/201.25 |
| 5,078,130 | 1/1992 | Van Oosten et al. | 128/201.25 |

FOREIGN PATENT DOCUMENTS

| | | | |
|---|---|---|---|
| 4161173 | 6/1992 | Japan | 128/205.29 |

*Primary Examiner*—Kimberly L. Asher

[57] ABSTRACT

A helmet includes a casing engaged in the helmet for accommodating air or pressurized oxygen, a mask secured to the helmet, an inlet pipe connecting the casing to the mask for supplying air into the mask. Fresh air or oxygen accommodated in the casing can be supplied into the mask via the inlet pipe. A bypass is formed in the body and connected to the mask, the exhaled gas in the mask can be sucked out of the mask when air flows through the bypass.

1 Claim, 7 Drawing Sheets

THREE-LAYER HELMET ASSEMBLY WITH BREATHING GAS THROTTLE

BACKGROUND OF THE INVENTION

1. Field of the Invention

The present invention relates to a helmet, and more particularly to a helmet having oxygen supplying system for supplying oxygen to the users.

2. Description of the Prior Art

Seriously polluted areas have been greatly increased in our environment, the riders of the bicycles or motorcycles may breathe exhaust air from vehicles and the polluted gas, even when the riders wear helmet.

The present invention has arisen to mitigate and obviate the afore-described disadvantages of the conventional helmets.

SUMMARY OF THE INVENTION

The primary objective of the present invention is to provide a helmet having an oxygen supplying system for supplying fresh oxygen to the users.

Accordingly, a helmet comprises a body, a casing, a mask, a tube, a filter means, a throttle means and an outlet means. The body is adapted to enclose the head of a wearer. The body includes a bypass formed in the body. The bypass has an entrance means for allowing breathable gas to flow into the bypass. The body further includes an ambient air access port formed therein. A casing is adapted to enclose the head of a wearer positioned inside of the body. The casing comprises a breathable gas reservoir and an outlet port. A mask is secured to the body defining an enclosed space and adapted to cover the nose and mouth of a wearer. The mask includes an inlet pipe connected to the outlet port of the breathable gas reservoir and supplying breathable gas into the mask. The mask includes a partition means for separating the mask into a first space for receiving exhaled gas, and a second space communicating with the inlet pipe for receiving breathable gas from the breathable gas reservoir. A tube connects the ambient air access port of the body to the mask. A filter means is disposed in the ambient air access port for filtering air flowing through the ambient air access port into the mask. A throttle means is disposed in the inlet pipe for controlling the flow of breathable gas. An outlet means communicates with the first space for discharging exhaled gas. The outlet means connects to the entrance means for drawing exhaled gas outward through the outlet means responsive to breathable gas flowing through the bypass to the mask.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
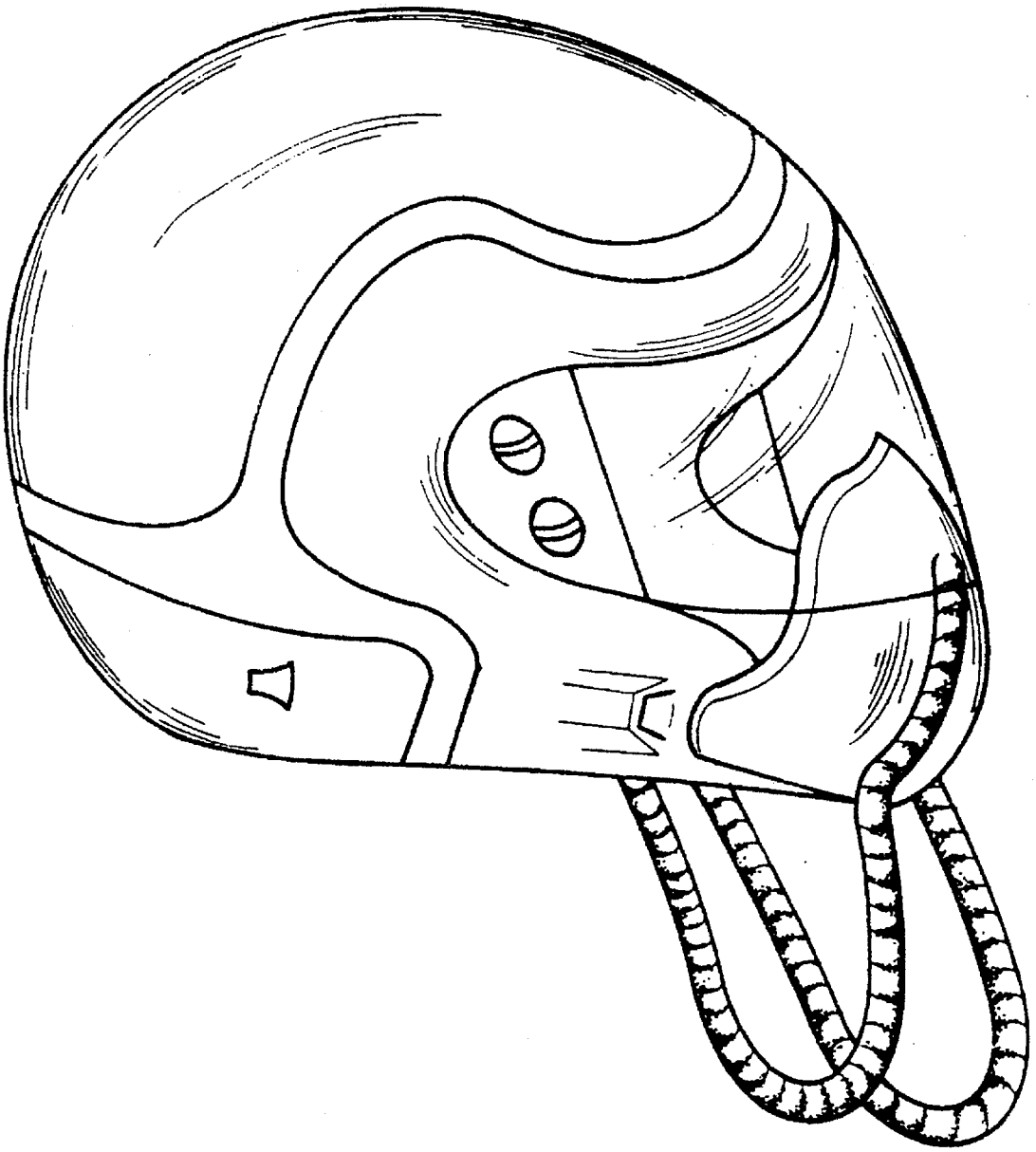
FIG. 1 is a perspective view of a helmet having an oxygen supplying system in accordance with the present invention.
Figure 2:
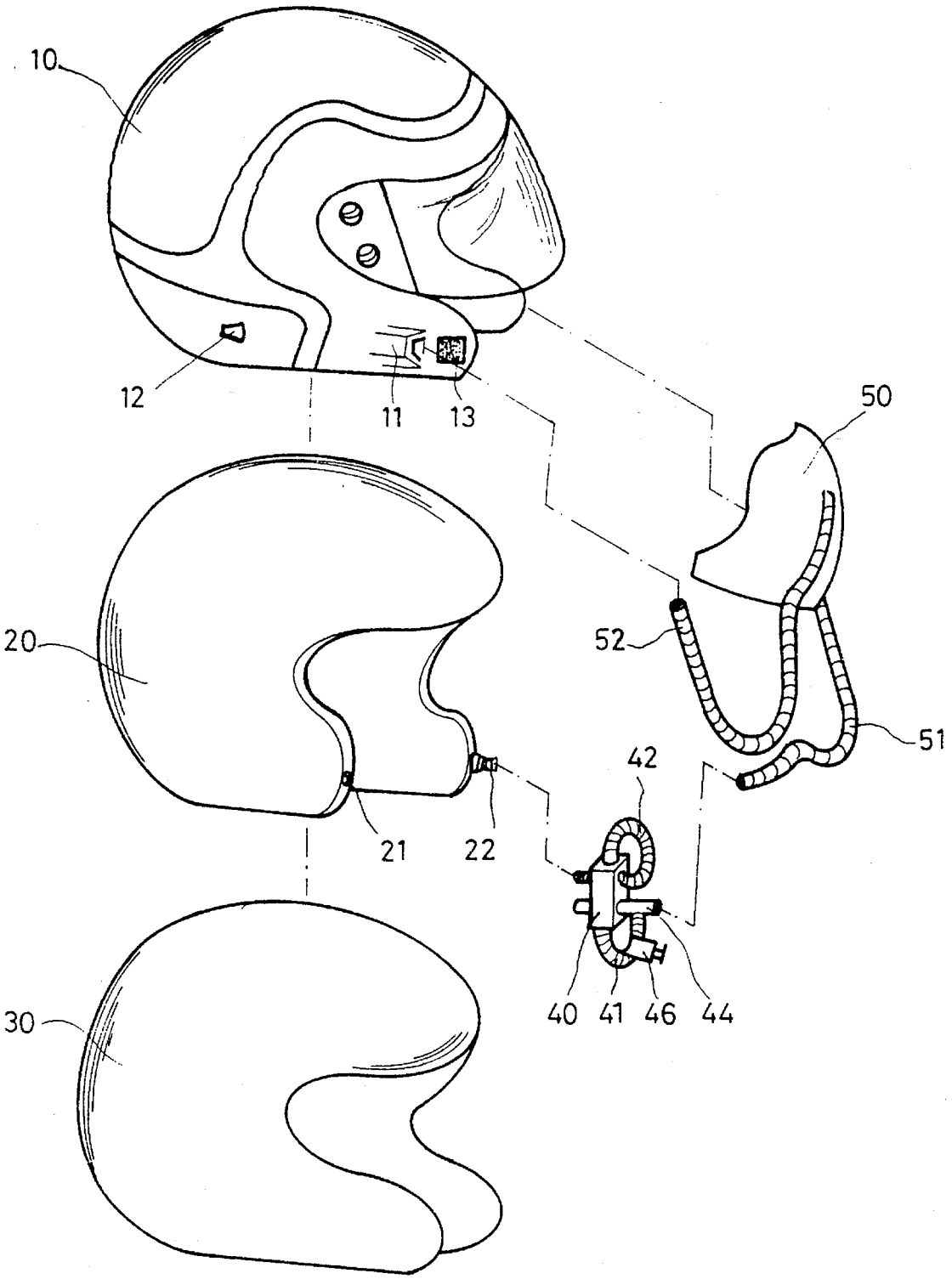
FIG. 2 is an exploded view of the helmet.
Figure 3:
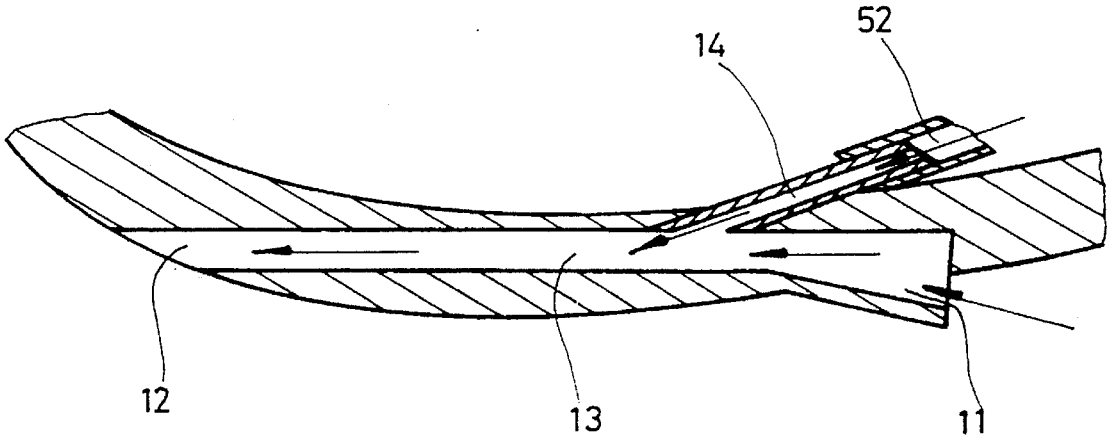
FIG. 3 is a partial cross sectional view illustrating the air outlet of the helmet.

Referring to the drawings, and initially to FIGS. 1, 2 and 3, a helmet in accordance with the present invention comprises generally an oxygen supplying system for supplying oxygen to the users; the helmet comprises a body 10 including a bypass 13 formed therein having an inlet 11 and an outlet port 12, an entrance 14 communicating with the bypass 13, a casing including a shape corresponding to the body 10 for being disposed in the body 10 and for accommodating fresh air, such as pressurized oxygen, a cap 30 including a shape corresponding to the casing 20 for being disposed in the casing 20 and including a mouth for filling fresh air into the casing 20 and an exit 22, a mouthpiece or a mask 50 secured to the body 10 by hook and loop device 15, an inlet pipe 51 coupling the casing 20 to the mask 50 for supplying fresh air into the mask 50, an outlet pipe 52 connected between the mask 50 and the entrance 14 of the body 10, and a throttle device 40 for controlling the flowing of the fresh air.

Figure 4:
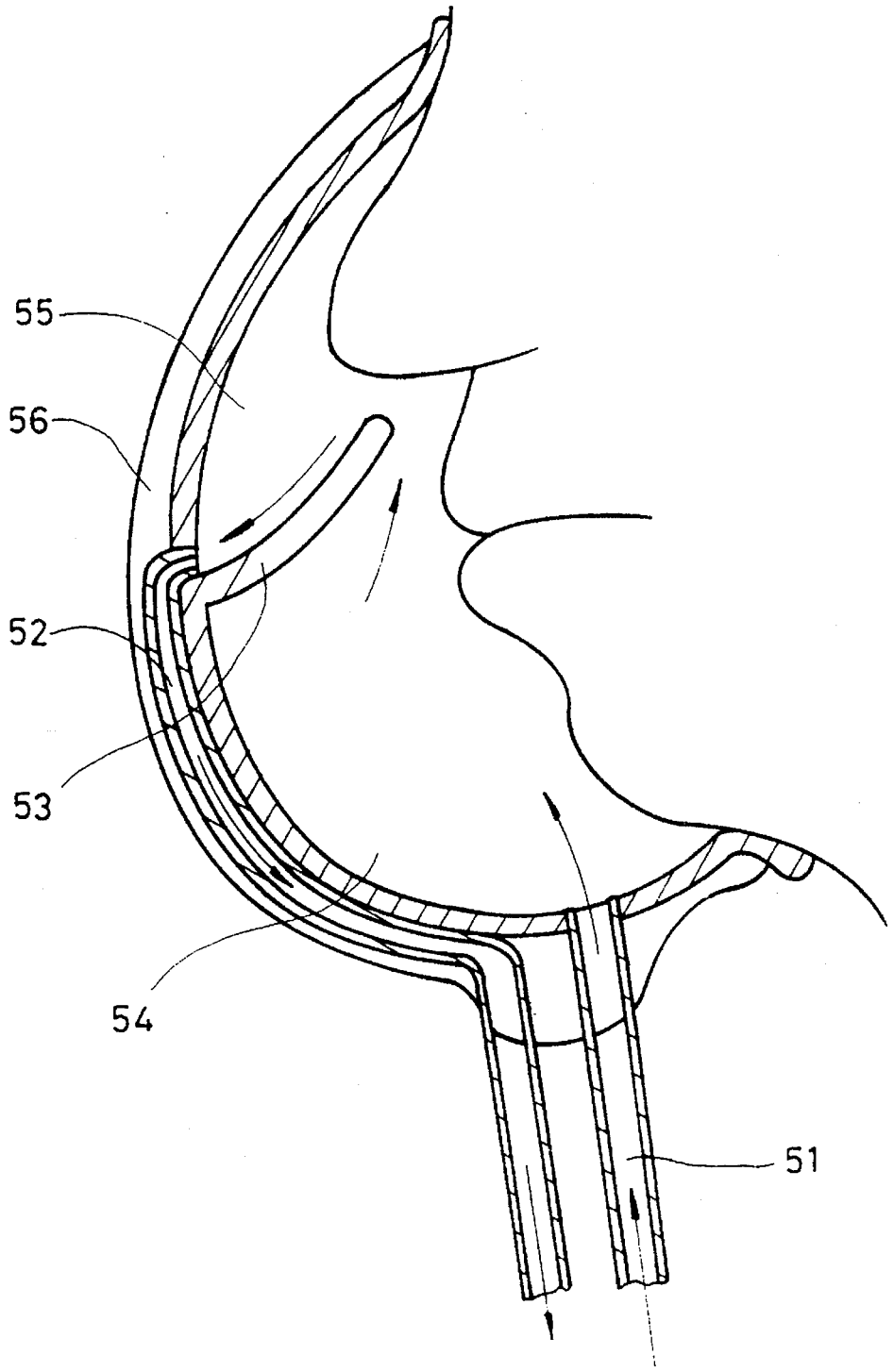
FIG. 4 is a cross section of the mask.

Referring next to FIG. 4, the mask 50 includes a partition 53 formed therein for separating the interior of the mask 50 into a first space 55 for receiving the breathed air of the users and for discharging the breathed air into the outlet pipe 52, and a second space 54 connected to the inlet pipe 51 for receiving the fresh air from the casing 20, another cover 56 may further be provided for at least covering the outlet pipe 52. It is to be noted that the air flowing through the bypass 13 generates a suction force for sucking the breathed air in the first space 55.

Figure 5:
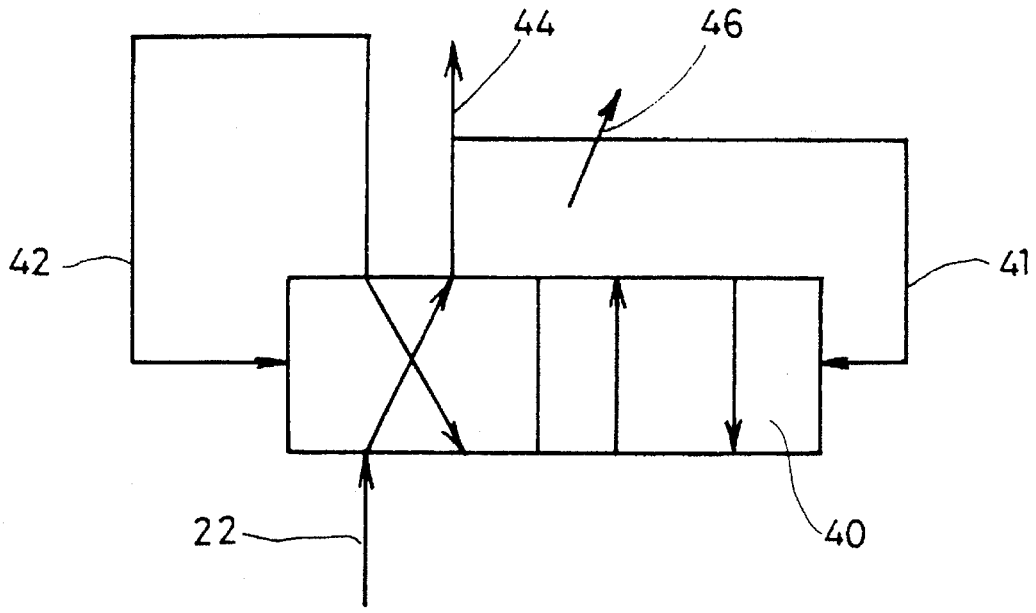
FIGS. 5 and 6 are schematic views showing the oxygen flowing path.
Figure 6:
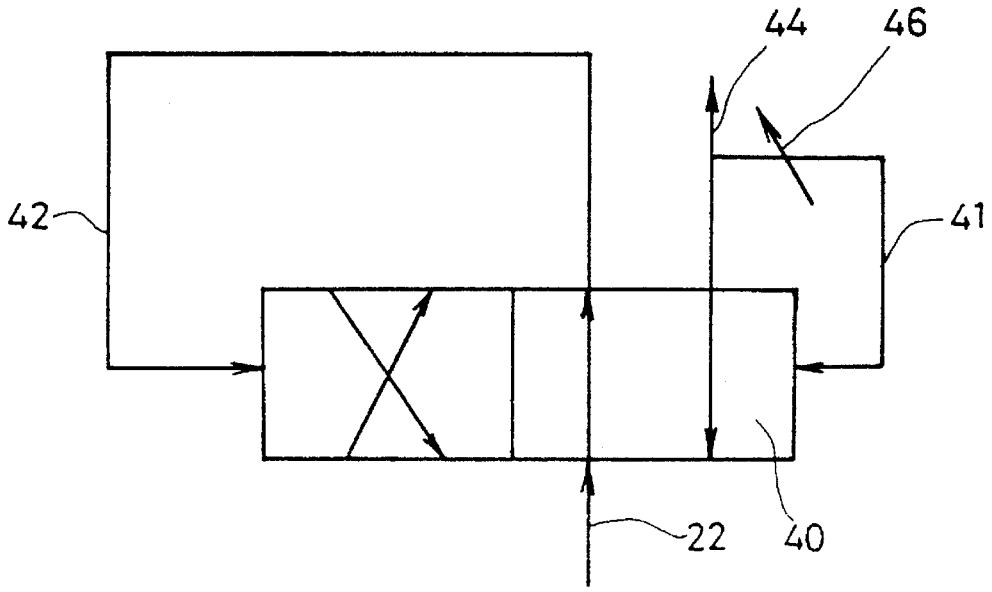

Referring next to FIGS. 5 and 6, and again to FIG. 2, the throttle device 40 is connected to the exit 22 of the casing 20 for controlling the flowing the fresh air from the casing 20 to the mask 50, the illustrated throttle device 40 is a typical throttle device and includes two loops 41, 42, a passage 44 connected to the inlet pipe 51, and a button 46 disposed in the loop 41, when the button 46 is depressed to block the loop 41 such that air may not flow through the loop 41, as shown in FIG. 5, the air from the exit 22 directly flows through the device 40 and flows out through the passage 44 such that air may flow into the mask 50 continuously, however, when the button 46 is released such that air may flow through the loop 41, as shown in FIG. 6, part of the air flowing through the passage 44 may flow through the loop 41 and may flow into the device 40 for actuating the device 40, this part of air will then be blocked and the air from the exit 22 will be caused to flow into the other loop 42 and will act on the device 40 again such that the air from the exit 22 will flow through the passage 44 again, whereby, only part of the air from the exit 22 will flow through the passage 44, the throttle device 40 is commercially available and will not be described in further details.

Figure 7:
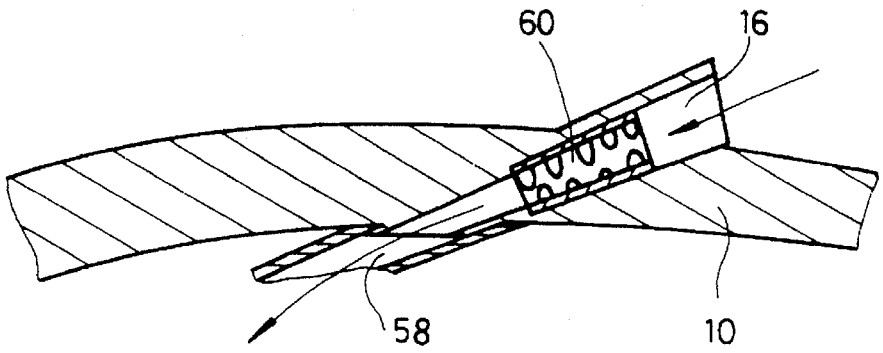
FIG. 7 is a partial cross sectional view illustrating portion of the helmet.
Figure 8:
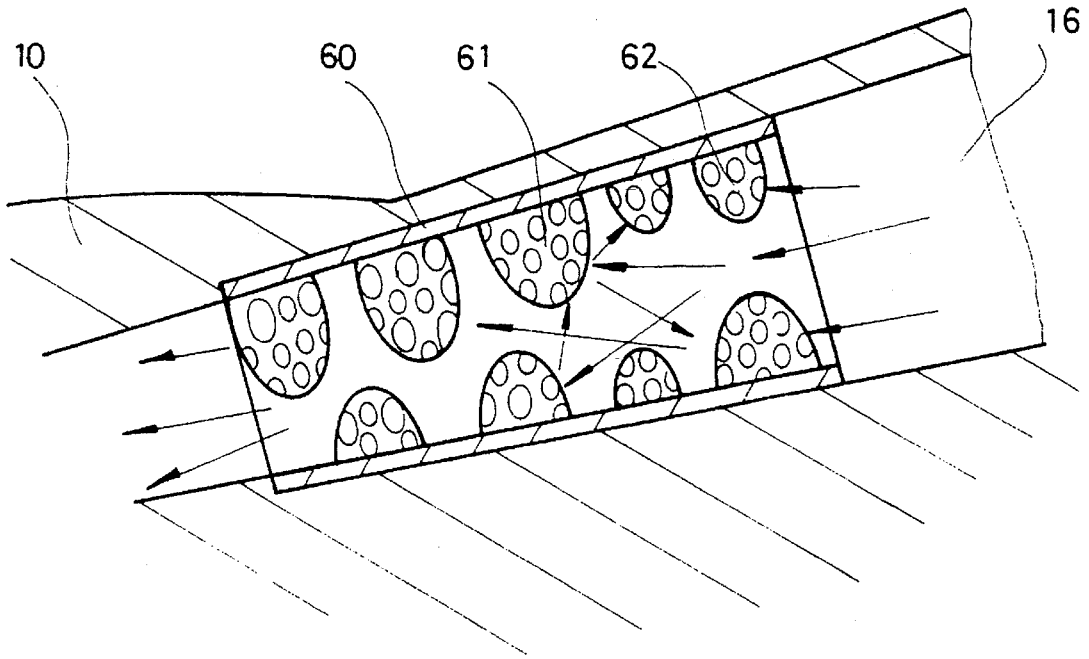
FIG. 8 is an enlarged cross sectional view showing the portion as shown in FIG. 7.
Figure 9:
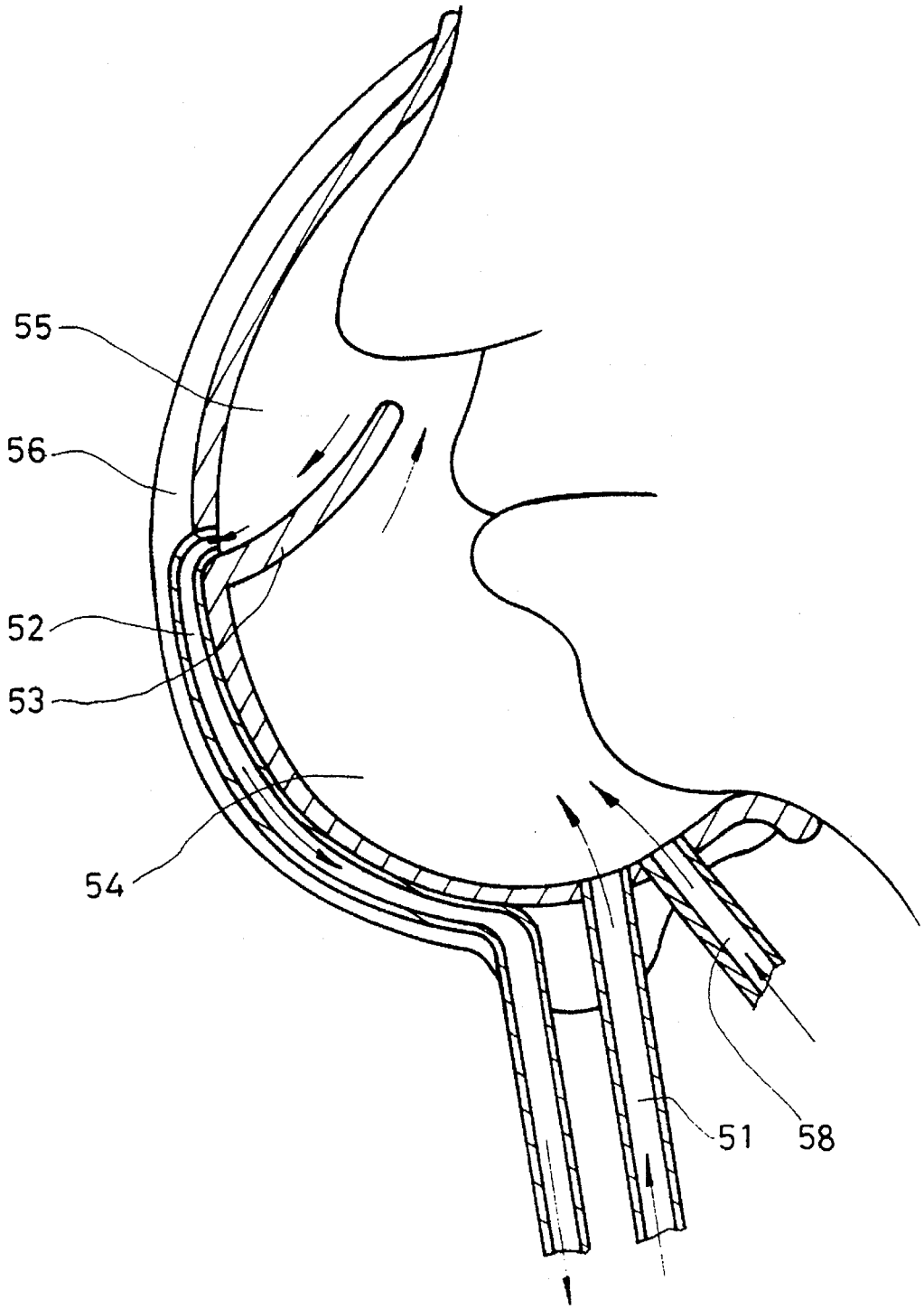
FIG. 9 is a cross sectional view illustrating the operation of the mask.

Referring next to FIGS. 7, 8 and 9, in addition to the bypass 11, an ambient access port 16 is formed in the body 10 and connected to the mask 50 by a tube 58, a filter 60 is disposed in the ambient access port 16 and includes a number of elements 61 which are made of foamable materials including a number of orifices 62 formed therein such that air flowing through the tube 58 via the access 16 can be suitably filtered, this device is an auxiliary device for supplying filtered air into the mask when fresh air accommodated within the casing 20 is exhausted.

Accordingly, the helmet in accordance with the present invention includes an oxygen supplying system for supplying fresh air or oxygen into the mask such that the users may breathe fresh air.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A helmet comprising:

a body adapted to enclose the head of a wearer, said body including a bypass formed in said body, said bypass having an entrance means for allowing breathable gas to flow into said bypass, said body further including an ambient air access port formed therein;

a casing adapted to enclose the head of a wearer positioned inside of said body, said casing comprising a breathable gas reservoir and an outlet port;

a mask secured to said body defining an enclosed space and adapted to cover the nose and mouth of a wearer, said mask including an inlet pipe connected to said outlet port of said breathable gas reservoir and supplying breathable gas into said mask, said mask including a partition means for separating said mask into a first space for receiving exhaled gas, and a second space communicating with said inlet pipe for receiving breathable gas from said breathable gas reservoir;

a tube connecting said ambient air access port of said body to said mask;

a filter means disposed in said ambient air access port for filtering air flowing through said ambient air access port into said mask;

throttle means disposed in said inlet pipe for controlling the flow of breathable gas; and an outlet means communicating with said first space for discharging exhaled gas, said outlet means connected to said entrance means for drawing exhaled gas outward through said outlet means responsive to breathable gas flowing through said bypass to said mask.

* * * * *